US011488460B2

(12) United States Patent
Cho

(10) Patent No.: US 11,488,460 B2
(45) Date of Patent: Nov. 1, 2022

(54) FIRE ALARM SYSTEM

(71) Applicant: ROZETATECH Co., Ltd., Gyeonggi-do (KR)

(72) Inventor: Youngjin Cho, Chungcheongbuk-do (KR)

(73) Assignee: ROZETATECH CO., LTD., Seongnam-si (KR)

( * ) Notice: Subject to any disclaimer, the term of this patent is extended or adjusted under 35 U.S.C. 154(b) by 0 days.

(21) Appl. No.: 17/440,539

(22) PCT Filed: Mar. 23, 2020

(86) PCT No.: PCT/KR2020/003961
§ 371 (c)(1),
(2) Date: Sep. 17, 2021

(87) PCT Pub. No.: WO2020/197226
PCT Pub. Date: Oct. 1, 2020

(65) Prior Publication Data

US 2022/0076551 A1 Mar. 10, 2022

(30) Foreign Application Priority Data

Mar. 22, 2019 (KR) ..... 10-2019-0033028

(51) Int. Cl.
*G08B 17/00* (2006.01)
*G08B 25/00* (2006.01)
(Continued)

(52) U.S. Cl.
CPC ..... *G08B 17/00* (2013.01); *G08B 25/009* (2013.01); *G08B 25/10* (2013.01); *G08B 29/185* (2013.01)

(58) Field of Classification Search
CPC ..... G08B 17/00; G08B 25/009; G08B 25/10; G08B 29/185; G08B 25/14
See application file for complete search history.

(56) References Cited

U.S. PATENT DOCUMENTS 4,141,007 A * 2/1979 Kavasilios ..... G08B 29/06 340/628
5,019,805 A * 5/1991 Curl ..... G08B 7/06 340/331
(Continued)

FOREIGN PATENT DOCUMENTS

JP H 05-151475 A 6/1993
JP 2013-084037 A 5/2013
(Continued)

OTHER PUBLICATIONS

International Search Report of the International Searching Authority, dated Jul. 1, 2020, from International Application No. PCT/KR2020/003961, filed on Mar. 23, 2020. 5 pages.
(Continued)

*Primary Examiner* — Ojiako K Nwugo
(74) *Attorney, Agent, or Firm* — HoustonHogle LLP

(57) ABSTRACT

A fire alarm system according to an embodiment of the inventive concept includes a plurality of sensing systems, each sensing whether a fire has occurred, and a plurality of relay systems each corresponding to any one of the plurality of sensing systems, performing Radio Frequency (RF) communication with the plurality of sensing systems, and performing RF communication with each other, wherein each of the plurality of sensing systems includes a plurality of sensing units having different address information, wherein when detecting a fire, each of the plurality of sensing units transmits alarm information to a corresponding relay system among the plurality of relay systems, wherein when receiving alarm information from another adjacent sensing unit, each of the plurality of sensing units transmits the alarm information to a corresponding relay system among the plurality of relay systems, wherein each of the plurality of relay systems includes a memory in which information of parties corresponding to the address information is stored,
(Continued)

and a reception unit configured to receive the alarm information from the plurality of sensing units, wherein when receiving the alarm information, the reception unit transmits a warning message to devices corresponding to the parties, and transmits the alarm information to adjacent relay systems among the plurality of relay systems.

10 Claims, 9 Drawing Sheets

(51) Int. Cl.
*G08B 25/10* (2006.01)
*G08B 29/18* (2006.01)

(56) References Cited

U.S. PATENT DOCUMENTS 10,043,378 B2 * 8/2018 Otis ..... G08B 5/22
2001/0038336 A1 * 11/2001 Acevedo ..... G08B 7/06 340/517
2005/0190055 A1 * 9/2005 Petite ..... G08B 17/10 340/506
2005/0200492 A1 * 9/2005 Woodard ..... G08B 25/08 340/539.1
2011/0080295 A1 * 4/2011 Nakamura ..... G08B 25/10 340/577
2011/0312354 A1 * 12/2011 Nakamura ..... G08B 25/004 455/226.1
2012/0218099 A1 * 8/2012 Egawa ..... G08B 25/009 340/502
2013/0343202 A1 * 12/2013 Huseth ..... G08B 17/00 370/244
2016/0071402 A1 * 3/2016 Chiarizio ..... G08B 27/00 340/539.17
2017/0140619 A1 * 5/2017 Russo ..... G08B 25/10
2017/0241200 A1 * 8/2017 Feldstein ..... E06B 9/68
2018/0374330 A1 * 12/2018 Balaji ..... G08B 25/10
2020/0080739 A1 * 3/2020 Koss ..... F24F 11/62
2020/0380835 A1 * 12/2020 Simpson ..... H04W 4/90
2022/0076551 A1 * 3/2022 Cho ..... G08B 29/16

FOREIGN PATENT DOCUMENTS

KR 10-0704018 B1 4/2007
KR 2014-017023 A 1/2014
KR 10-1790303 B1 10/2017

OTHER PUBLICATIONS

Written Opinion, dated Jul. 1, 2020, from International Application No. PCT/KR2020/003961, filed on Mar. 23, 2020. 10 pages.
International Preliminary Report on Patentability, dated Oct. 7, 2021, from International Application No. PCT/KR2020/003961, filed on Mar. 23, 2020. 16 pages.

* cited by examiner

FIRE ALARM SYSTEM

TECHNICAL FIELD

The inventive concept relates to a fire alarm system, and specifically to a fire alarm system that easily provides information on whether a fire has occurred to a user through mutual communication between a plurality of sensing systems and a plurality of relay systems, and is operated with low power using a power saving mode that does not consume power and a normal mode operating in a fire situation.

BACKGROUND ART

In general, a fire alarm system is installed in a building to reduce human casualties in case of fire. This fire alarm system is a system that generates an alarm to a person or a resident in a building with an alarm device such as a bell, siren, or indicator light through a relay system when a fire is automatically detected through a sensor that detects heat, smoke, flame, and the like generated by a fire or a predetermined alarm is operated by a fire detector.

However, the fire alarm system has difficulties in notifying the person concerned or the occupants of the building when a malfunction occurs in the relay system.

DISCLOSURE OF THE INVENTION

Technical Problem

The present disclosure provides a fire alarm system with improved reliability through mutual communication between a plurality of relay systems.

The present disclosure provides a fire alarm system that may be operated with low power.

Technical Solution

A fire alarm system according to an embodiment of the inventive concept includes a plurality of sensing systems, each sensing whether a fire has occurred, and a plurality of relay systems each corresponding to any one of the plurality of sensing systems, performing Radio Frequency (RF) communication with the plurality of sensing systems, and performing RF communication with each other, wherein each of the plurality of sensing systems includes a plurality of sensing units having different address information, wherein when detecting a fire, each of the plurality of sensing units transmits alarm information to a corresponding relay system among the plurality of relay systems, wherein when receiving alarm information from another adjacent sensing unit, each of the plurality of sensing units transmits the alarm information to a corresponding relay system among the plurality of relay systems, wherein each of the plurality of relay systems includes a memory in which information of parties corresponding to the address information is stored, and a reception unit configured to receive the alarm information from the plurality of sensing units, wherein when receiving the alarm information, the reception unit transmits a warning message to devices corresponding to the parties, and transmits the alarm information to adjacent relay systems among the plurality of relay systems.

When the alarm information is not received from a corresponding relay system among the plurality of relay systems, each of the plurality of sensing units may transmit the alarm information to another adjacent relay system among the plurality of relay systems.

Each of the plurality of relay systems may receive big data from an external server, and use the big data to determine whether values sensed by the plurality of sensing units are invalid data such as water vapor, cigarette smoke, and exhaust gas.

Each of the plurality of relay systems may analyze data on the address information using the big data, identify subparties that should receive the warning message in addition to information on parties corresponding to the address information, and transmit the warning message to the subparties.

When alarm information is received from any one of the plurality of relay systems, each of the plurality of sensing units may store a signal transmission path of the alarm information.

The fire alarm system further includes an activation signal for changing from a power saving mode that does not consume power to a normal mode operated when the fire is detected and a first alarm transmission signal including the alarm information, wherein if the fire is detected, after changing from the power saving mode to the normal mode, each of the plurality of sensing units may transmit the first alarm transmission signal to a corresponding relay system among the plurality of relay systems, transmit the activation signal to an adjacent sensing unit among the plurality of sensing units, and transmit a first alarm transmission signal after a predetermined time elapses.

The fire alarm system further includes a second alarm transmission signal amplifying the first alarm transmission signal, wherein when receiving the activation signal, after changing from the power saving mode to the normal mode, each of the plurality of sensing units may transmit the second alarm transmission signal to a corresponding relay system among the plurality of relay systems, transmit the activation signal to an adjacent sensing unit among the plurality of sensing units, and transmit the second alarm transmission signal after a predetermined time elapses.

Each of the plurality of sensing units may operate in the power saving mode, and operate in the normal mode when a magnitude of the received activation signal is greater than or equal to a predetermined value.

Each of the plurality of sensing units may ignore the received alarm information when the same alarm information as the previously received alarm information is received.

When the same alarm information as previously received alarm information is received, each of the plurality of relay systems may ignore the received alarm information.

A fire alarm system according to an embodiment of the inventive concept includes: a plurality of sensing systems each sensing whether a fire has occurred; and a plurality of relay systems each corresponding to any one of the plurality of sensing systems, performing Radio Frequency (RF) communication with the plurality of sensing systems, and performing RF communication with each other, wherein each of the plurality of sensing systems includes a plurality of sensing units having different address information and including a first sensing unit and a second sensing unit, wherein the first sensing unit transmits alarm information only to at least one relay system among the plurality of relay systems, wherein the second sensing unit transmits the alarm information only to the plurality of sensing units, wherein each of the plurality of relay systems includes: a memory in which information of parties corresponding to the address information is stored; and a reception unit configured to receive the alarm information from the plurality of sensing units, wherein when receiving the alarm information, the reception unit transmits a warning message to devices corresponding to the parties, and delivers the alarm information to adjacent relay systems among the plurality of relay systems.

When the alarm information is not received from a corresponding relay system among the plurality of relay systems, each of the plurality of sensing units may transmit the alarm information to another adjacent relay system among the plurality of relay systems.

Each of the plurality of relay systems may receive big data from an external server, and use the big data to determine whether values sensed by the sensing units are invalid data such as water vapor, cigarette smoke, and exhaust gas.

When alarm information is received from any one of the plurality of relay systems, each of the plurality of sensing units may store a signal transmission path of the alarm information.

Advantageous Effects

According to the inventive concept, when implementing a fire alarm system, even if at least one of the plurality of relay systems malfunctions through mutual communication between a plurality of sensing systems and a plurality of relay systems using Radio Frequency (RF) communication and big data, alarm information may be stably transmitted through another adjacent relay system among a plurality of relay systems. Therefore, it is possible to provide a fire alarm system with improved reliability.

In addition, the sensing system is divided into a power saving mode in which power is not consumed and a normal mode operating in a fire situation, thereby minimizing power use of the sensing unit. Therefore, the fire alarm system may be operated with low power.

MODE FOR CARRYING OUT THE INVENTION

Figure 1:
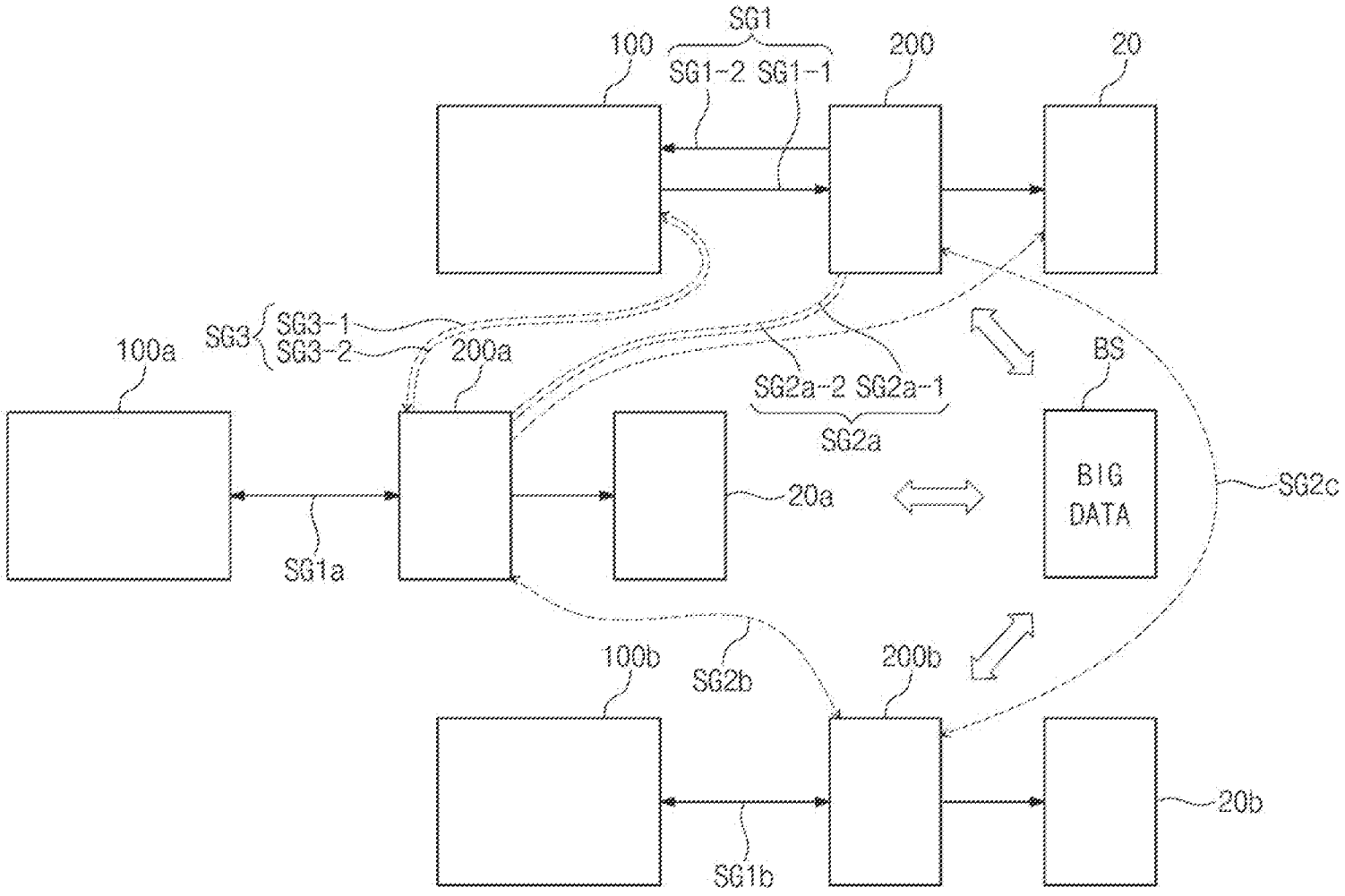
FIG. 1 illustrates a fire alarm system according to an embodiment of the inventive concept.

In this specification, when an element (or region, layer, part, etc.) is referred to as being "on", "connected to", or "coupled to" another element, it means that it may be directly placed on/connected to/coupled to other components, or a third component may be arranged between them.

Like reference numerals refer to like elements. Additionally, in the drawings, the thicknesses, proportions, and dimensions of components are exaggerated for effective description.

"And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of components shown in the drawing. The terms are described as a relative concept based on a direction shown in the drawing.

Unless otherwise defined, all terms (including technical and scientific terms) used herein have the same meaning as commonly understood by one of ordinary skill in the art to which this inventive concept belongs. In addition, terms defined in a commonly used dictionary should be interpreted as having a meaning consistent with the meaning in the context of the related technology, and unless interpreted in an ideal or overly formal sense, the terms are explicitly defined herein.

In various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components.

Hereinafter, embodiments of the inventive concept will be described with reference to the drawings.

FIG. 1 illustrates a fire alarm system FAS according to an embodiment of the inventive concept.

Referring to FIG. 1, the fire alarm system FAS may include a plurality of sensing systems 100, 100*a*, and 100*b* and a plurality of relay systems 200, 200*a*, and 200*b*. In FIG. 1, three sensing systems and three relay systems are illustrated, respectively, but the inventive concept is not limited thereto.

Each of the plurality of sensing systems 100, 100*a*, and 100*b* may detect whether a fire has occurred.

Each of the plurality of relay systems 200, 200*a*, and 200*b* corresponds to any one of the plurality of sensing systems 100, 100*a*, and 100*b*, and performs communication with the plurality of sensing systems 100, 100*a*, and 100*b*, and the plurality of relay systems 200, 200*a*, and 200*b* may communicate with each other.

For example, the sensing system 100 may communicate with the relay system 200, the sensing system 100*a* may communicate with the relay system 200*a*, and the sensing system 100*b* may communicate with the relay system 200*b*.

Each of the plurality of relay systems 200, 200*a*, and 200*b* may transmit a warning message to each of the plurality of parties 20, 20*a*, and 20*b* based on the alarm information received from the plurality of sensing systems 100, 100*a*, and 100*b*.

The alarm information may include address information, fire information, and signal transmission path information. However, this is an example, and the alarm information of the inventive concept may include various information necessary for a fire alarm system.

The fire alarm system FAS may include first signals SG1, SG1*a*, and SG1*b*, second signals SG2*a*, SG2*b*, and SG2*c*, and a third signal SG3.

Each of the first signals SG1, SG1*a*, and SG1*b* may include the alarm information. Each of the first signals SG1, SG1*a*, and SG1*b* may include a first transmission signal and a first reception signal. For example, the first signal SG1 may include a first transmission signal SG1-1 and a first reception signal SG1-2.

Each of the plurality of sensing units 110, 110*a*, and 110*b* may transmit the first transmission signal to a corresponding relay system among the plurality of relay systems 200, 200*a*, and 200*b* when a fire is detected. When receiving the first transmission signal, each of the plurality of relay systems 200, 200*a*, and 200*b* may transmit the first reception signal to a sensing unit corresponding to the first transmission signal among the plurality of sensing units 110, 110*a*, and 110*b*. Each of the plurality of sensing units 110, 110*a*, and 110*b* may receive the first reception signal from each of the plurality of relay systems 200, 200*a*, and 200*b*.

Each of the second signals SG2, SG2*a*, and SG2*b* may include the alarm information. Each of the second signals SG2*a*, SG2*b*, and SG2*c* may include a second transmission signal and a second reception signal. For example, the first signal SG1 may include a first transmission signal SG1-1 and a first reception signal SG1-2.

Each of the plurality of relay systems 200, 200*a*, and 200*b* may communicate with each other through second signals SG2*a*, SG2*b*, and SG2*c* respectively. When receiving each of the first signals SG1, SG1*a*, and SG1*b*, each of the plurality of relay systems 200, 200*a*, and 200*b* transmits alarm information included in each of the first signals SG1, SG1*a*, and SG1*b* to an adjacent relay system among the plurality of relay systems 200, 200*a*, and 200*b* through each of the second signals SG2*a*, SG2*b*, and SG2*c*.

According to the inventive concept, when implementing the fire alarm system FAS, even when at least one of the plurality of relay systems 200, 200*a*, and 200*b* malfunctions due to mutual communication between the plurality of sensing systems 100, 100*a*, and 100*b* and the plurality of relay systems 200, 200*a*, and 200*b*, the alarm information may be stably transmitted through an adjacent relay system among the plurality of relay systems 200, 200*a*, and 200*b*. Accordingly, it is possible to provide the fire alarm system FAS with improved reliability.

The third signal SG3 may include the alarm information. The third signal SG3 may include a third transmission signal SG3-1 and a third reception signal SG3-2.

For example, the sensing system 100 may transmit the first transmission signal SG1-1 to the relay system 200. In this case, the relay system 200 may not transmit the first reception signal SG1-2. If the sensing system 100 does not receive the first reception signal SG1-2, it may transmit the alarm information to the adjacent relay system 200*a* through the third transmission signal SG3-1. The adjacent relay system 200*a* may receive the third transmission signal SG3-1 and transmit the third reception signal SG3-2 to the sensing system 100. The adjacent relay system 200*a* may transmit the warning message to parties corresponding to the address information by using the address information of the alarm information. At this time, the sensing system 100 may store the signal transmission path of the alarm information. The plurality of sensing systems 100, 100*a*, and 100*b* may perform rapid communication with the plurality of relay systems 200, 200*a*, and 200*b* through the stored signal transmission path. However, this is exemplary and in the inventive concept, each of the plurality of sensing systems 100, 100*a*, and 100*b* and the plurality of relay systems 200, 200*a*, and 200*b* may communicate through the third signal SG3.

According to the inventive concept, when implementing the fire alarm system FAS, the plurality of sensing systems 100, 100*a*, and 100*b* may communicate with adjacent relay systems among the plurality of relay systems 200, 200*a*, and 200*b*. The alarm information may be stably transmitted through an adjacent relay system among the plurality of relay systems 200, 200*a*, and 200*b*. Accordingly, it is possible to provide the fire alarm system FAS with improved reliability.

An external server BS may be a device storing big data. The plurality of relay systems 200, 200*a*, and 200*b* may receive the big data from the external server BS.

The big data may include surrounding environment data for determining whether a fire has occurred. The surrounding environment data may include data corresponding to the probability of fire by date, data corresponding to the probability of occurrence of fire by time, data corresponding to the probability of fire occurrence by location, data corresponding to the probability of fire occurrence by temperature, data corresponding to the probability of fire occurrence by humidity, data corresponding to the probability of fire occurrence by weather, data corresponding to the probability of occurrence of fire by industry, or data corresponding to the probability of occurrence of fire by user.

For example, the data corresponding to the fire occurrence probability by date may include data corresponding to the fire occurrence probability by day of the week or the fire occurrence probability by month. The data corresponding to the fire occurrence probability by time may include data corresponding to the fire occurrence probability divided into dawn, morning, afternoon, evening, and late night. The data corresponding to the probability of occurrence of a fire by location may include data corresponding to the probability of occurrence of a fire divided into a city center, a mountainous region, a beach, and a rural area. The data corresponding to the fire occurrence probability for each temperature may include data corresponding to the fire occurrence probability divided into spring, summer, autumn, and winter. The data corresponding to the probability of occurrence of a fire by humidity may include data corresponding to the probability of occurrence of a fire for each specific humidity value. The data corresponding to the probability of occurrence of a fire by weather may include data corresponding to the probability of occurrence of a fire divided into a sunny day, a cloudy day, or a rainy day. Data corresponding to the probability of occurrence of a fire by industry may include data corresponding to the probability of occurrence of a fire divided into homes, restaurants, factories, and offices. The data corresponding to the fire occurrence probability for each user may include data corresponding to the fire occurrence probability divided by age, occupation, and gender.

The big data may be updated periodically.

Each of the plurality of relay systems 200, 200*a*, and 200*b* may determine whether a value sensed by each of the plurality of sensing systems 100, 100*a*, and 100*b* is valid data using the big data. For example, when the values sensed by each of the plurality of sensing systems 100, 100*a*, and 100*b* are data such as water vapor, cigarette smoke, and exhaust gas, each of the plurality of relay systems 200, 200*a*, and 200*b* may determine the data as invalid data.

Each of the plurality of relay systems 200, 200*a*, and 200*b* may analyze data on the address information using the big data, identify sub-parties that should receive the warning message in addition to information on parties corresponding to the address information, and transmit the warning message to the sub-parties.

For example, when a fire occurs, each of the plurality of relay systems 200, 200*a*, and 200*b* may transmit a warning message to a fire department having jurisdiction corresponding to a party using address information. In addition, each of the plurality of relay systems 200, 200*a*, and 200*b* uses the big data to determine a place where the fire may spread to transmit a warning message to the fire department having jurisdiction over the location corresponding to the sub-party.

Figure 2:
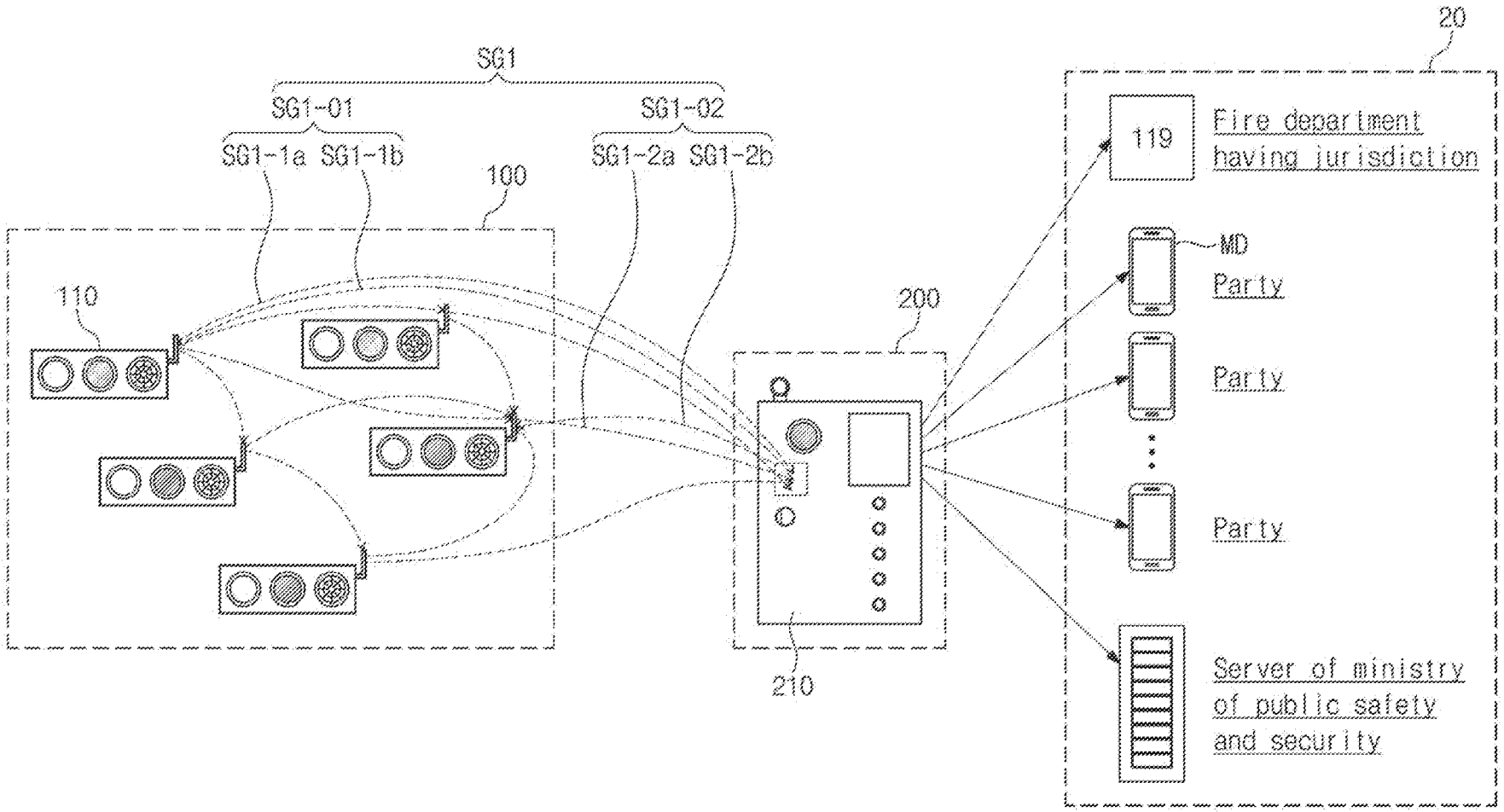
FIG. 2 is a flowchart illustrating a method in which the sensing system and the relay system shown in FIG. 1 operate.

FIG. 2 shows the sensing system 100 and the relay system 200 shown in FIG. 1.

Referring to FIG. 2, each of the plurality of sensing systems 100, 100*a*, and 100*b* may include substantially the same configuration. Each of the plurality of relay systems 200, 200*a*, and 200*b* may include substantially the same configuration. FIG. 2 exemplarily shows the sensing system 100 and the relay system 200, but is not limited thereto.

The sensing system 100 may include a plurality of sensing units. In FIG. 2, five sensing units are illustrated by way of example, but the inventive concept is not limited thereto.

Each of the plurality of sensing units may have different address information. Each of the plurality of sensing units may transmit alarm information including the address information to the relay system 200 when detecting a fire.

The first signal SG1 may include the alarm information. The first signal SG1 may be a signal transmitted between the plurality of sensing units and the relay system 200. The first signal SG1 may include a first alarm signal SG1-01 and a second alarm signal SG1-02.

The first alarm signal SG1-01 may be a signal for transmitting the alarm information to the relay system 200 when each of the plurality of sensing units detects a fire. The first alarm signal SG1-01 may include a first alarm transmission signal SG1-1*a* and a first alarm reception signal SG1-1*b*.

Each of the plurality of sensing units may transmit the alarm information to the relay system 200 when receiving the alarm information from another adjacent sensing unit.

The second alarm signal SG1-02 may be a signal for transmitting the alarm information to the relay system 200 when each of the plurality of sensing units receives a signal including the alarm information from another adjacent sensing unit. The second alarm signal SG1-02 may include a second alarm transmission signal SG1-2*a* and a second alarm reception signal SG1-2*b*.

The relay system 200 may include a repeater 210. The repeater 210 may receive the first alarm transmission signal SG1-1*a* and the second alarm transmission signal SG1-2*a*. The repeater 210 may transmit a warning message to a plurality of parties 20.

Each of a plurality of parties 20 may include a fire department having jurisdiction, parties where a fire occurred, the Ministry of Public Safety and Security (or public institutions related to public safety), and the like. Each of a plurality of parties 20 may receive a warning message in the form of a text message, a video message, or a voice message through a landline phone, a smart phone, or other mobile terminal.

Figure 3:
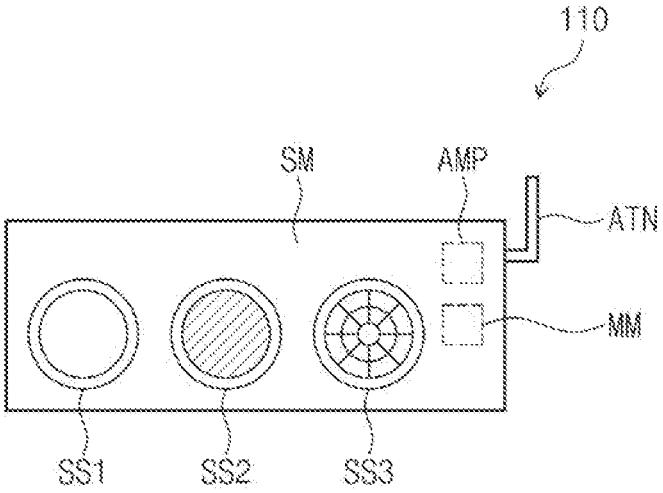
FIG. 3 illustrates a sensing unit among a plurality of sensing units of the sensing system shown in FIG. 1.

FIG. 3 illustrates one sensing unit 110 among a plurality of sensing units of the sensing system 100 shown in FIG. 1.

Referring to FIG. 3, any one sensing unit 110 among a plurality of sensing units may include a plurality of sensors SS1, SS2, and SS3 and a sensor module SM. In FIG. 3, three sensors are illustrated by way of example, but the inventive concept is not limited thereto.

The plurality of sensors SS1, SS2, and SS3 may include a first sensor SS1, a second sensor SS2, and a third sensor SS3. Each of the first sensor SS1, the second sensor SS2, and the third sensor SS3 may sense at least one of smoke, temperature, humidity, and gas. For example, the first sensor SS1 may detect smoke, the second sensor SS2 may detect temperature, and the third sensor SS3 may detect gas.

Each of the plurality of sensors SS1, SS2, and SS3 may generate a fire detection signal when it is determined that a fire has occurred by sensing at least one of smoke, temperature, humidity, and gas. The shape or type of the fire detection signal may be different for each of the sensors SS1, SS2, and SS3.

The sensor module SM may include a communication unit ATN (e.g., a communication circuit and/or an antenna for communication), an amplification unit AMP (or amplification circuit), and a sensor memory MM. The sensors SS1, SS2, and SS3 may be mounted on the sensor module SM.

The sensor module SM may receive a fire detection signal from at least one of the plurality of sensors SS1, SS2, and SS3 and generate alarm information.

The communication unit ATN of the sensor module SM may transmit an alarm signal including the alarm information to the relay system 200 (refer to FIG. 2), and may also transmit the alarm signal to another adjacent sensor module SM. The alarm signal may include a first alarm signal SG1-01 (refer to FIG. 2) and a second alarm signal SG1-02 (refer to FIG. 2). When the communication unit ATN and the relay system 200 (refer to FIG. 1) are far away from each other and it is difficult to directly transmit the alarm information, the communication unit ATN transmits the alarm information to another adjacent sensor module SM, thereby stably transmitting information to the relay system 200 (refer to FIG. 2).

In this case, as a method of transmitting the alarm information, a radio frequency (RF) communication method may be used. The RF communication method is a communication method for exchanging information by radiating radio frequency. The RF communication method is a broadband communication method using frequency, is less affected by climate and environment, and has high stability. In addition, voice and other additional functions may be linked, and the transmission speed is fast. For example, the RF communication method may use a frequency of 447 MHz to 924 MHz. In an embodiment of the inventive concept, a communication method such as Ethernet, Wifi, LoRA, M2M, 3G 4G 5G, LTE, LTE-M, Bluetooth, or WiFi Direct may be used.

In an embodiment of the inventive concept, the RF communication method may include a Listen Before Transmission (LBT) communication method. This is a frequency selection method that determines whether the selected frequency is being used by another system and selects another frequency when it is determined that the selected frequency is occupied. For example, a node that intends to transmit may first listen to the medium, determine if it is in an idle state, and then flush the backoff protocol prior to transmission. By distributing data using this LBT communication method, collisions between signals in the same band may be prevented.

The amplification unit AMP may amplify the alarm signal and convert the amplified alarm signal into a second alarm signal SG1-02 (refer to FIG. 2).

The sensor memory MM may store information on a plurality of sensors. The plurality of sensors may include sensors SS1, SS2, and SS3 mounted on the sensor module SM. The sensor module SM may detect the mounted sensors SS1, SS2, SS3, and automatically determine a modulation method for signals generated by the mounted sensors SS1, SS2, and SS3 through information stored in the sensor memory MM. Through this automatic modulation method, even if any kind of sensors are mounted on the sensor module SM, the sensors may be set to a state in which the alarm information may be easily transmitted.

The sensor memory MM may store a signal transmission path that is a path optimized for communication with the relay system 200 (refer to FIG. 1).

Each of the plurality of sensing units may include unique address information. The address information may include a product number, a manufacturing number, or a location (address) where the product is installed. In an embodiment of the inventive concept, the unique address information may be stored in the sensor memory MM, but is not limited thereto and may be stored in other ways.

The sensor memory MM may include a volatile memory or a non-volatile memory. Volatile memory may include DRAM, SRAM, flash memory, or FeRAM. Non-volatile memory may include SSD or HDD.

The sensing unit 110 may include a power saving mode (or standby mode) and a normal mode (or active mode). The sensing unit 110 may stand by in a power saving mode that minimizes power consumption in a situation where the occurrence of a fire is not detected. When a fire is detected or an activation signal is received, the sensing unit 110 may be activated in a normal mode state. For example, when at least one of the sensors SS1, SS2, and SS3 detects the occurrence of a fire and generates a fire detection signal, the sensor module SM, which has been waiting in the power saving mode state, may be activated in the normal mode.

According to the inventive concept, the sensing unit 110 is divided into a power saving mode in which power is not consumed and a normal mode operating in a fire situation, thereby minimizing power use of the sensing unit 110. Therefore, the fire alarm system FAS (refer to FIG. 1) may be driven with low power.

Figure 4A:
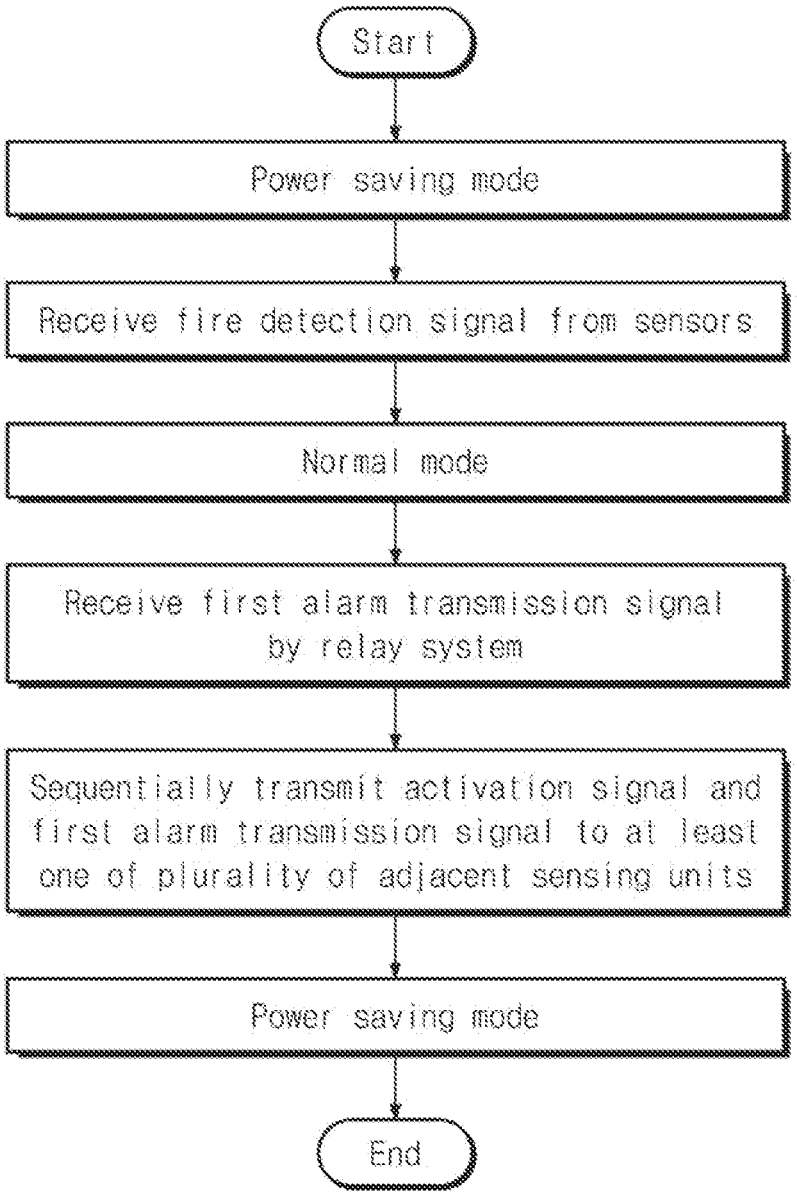
FIG. 4*a* is a flowchart illustrating a method in which a sensor module of the sensing unit shown in FIG. 3 operates.

FIG. 4*a* is a flowchart illustrating a method of operating the sensor module SM of the sensing unit 110 shown in FIG. 3.

Referring to FIGS. 2, 3, and 4*a*, FIG. 4*a* may be a process of transmitting the first alarm transmission signal SG1-1*a*.

The first alarm transmission signal SG1-1*a* may be a signal including alarm information generated by the fire detection signal generated by the sensors SS1, SS2, and SS3 mounted on the sensor module SM detecting a fire.

The sensor module SM may stand by in a power saving mode. When receiving a fire detection signal from the sensors SS1, SS2, and SS3, the communication unit ATN may change to the normal mode.

The communication unit ATN may transmit the first alarm transmission signal SG1-1*a* to the relay system 200. The relay system 200 that has received the first alarm transmission signal SG1-1*a* may transmit the first alarm reception signal SG1-1*b* to the communication unit ATN. The communication unit ATN may receive the first alarm reception signal SG1-1*b* from the relay system 200. The communication unit ATN may confirm that the relay system 200 has received the first alarm transmission signal SG1-1*a* by receiving the first alarm reception signal SG1-1*b*.

The communication unit ATN may sequentially transmit an activation signal for converting the power saving mode to the normal mode and a first alarm transmission signal SG1-1*a* to at least one sensing unit among a plurality of adjacent sensing units. The at least one sensing unit that has received the first alarm transmission signal SG1-1*a* may transmit the first alarm reception signal SG1-1*b* to the communication unit ATN. The communication unit ATN may receive the first alarm reception signal SG1-1*b* from the at least one sensing unit. The communication unit ATN may confirm that the at least one sensing unit has received the first alarm transmission signal SG1-1*a* by receiving the first alarm reception signal SG1-1*b*.

The sensor module SM may stand by again in a power saving mode.

According to the inventive concept, the sensor module SM may operate by being divided into a power saving mode that does not consume power and a normal mode that operates in a fire situation, thereby minimizing power use of the sensing unit 110. Therefore, the fire alarm system FAS (refer to FIG. 1) may be driven with low power.

Figure 4B:
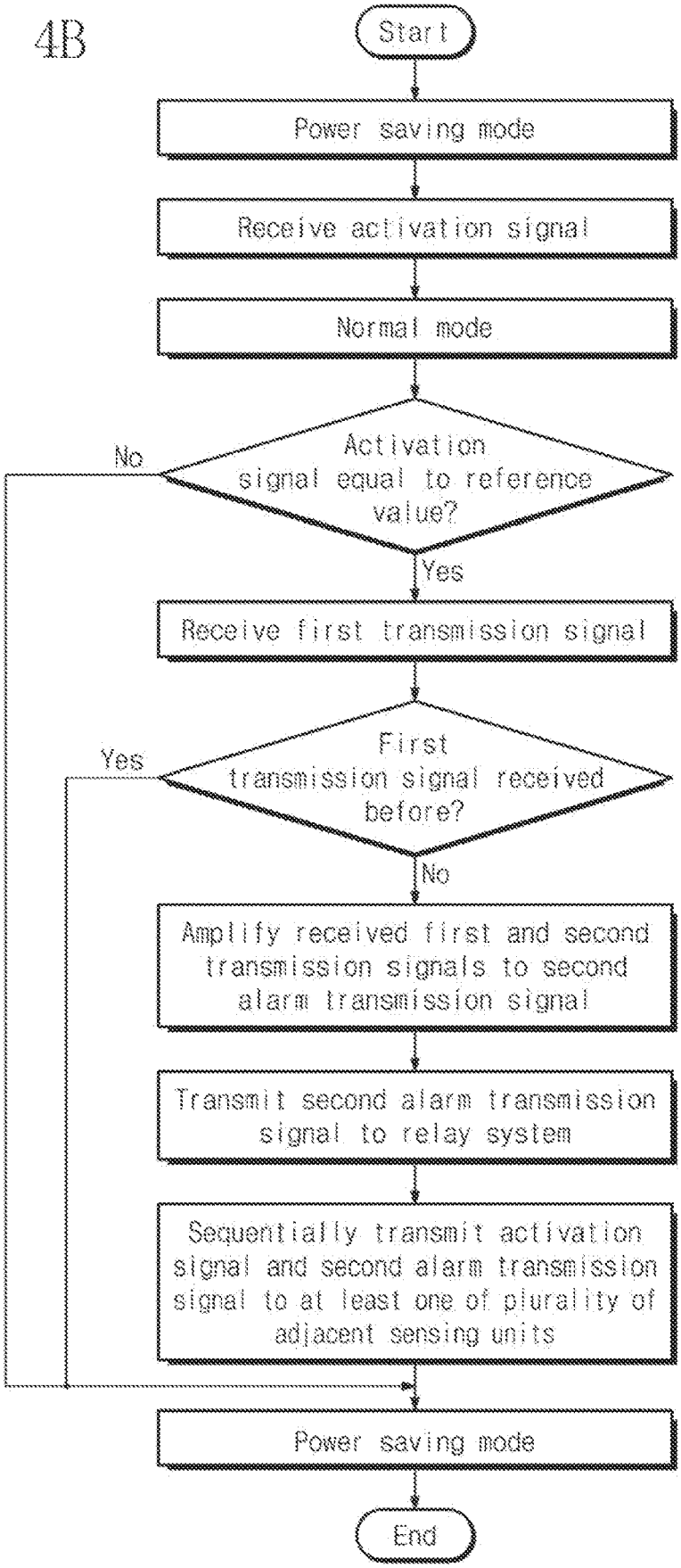
FIG. 4*b* is a flowchart illustrating a method in which a sensor module of the sensing unit shown in FIG. 3 operates.

FIG. 4*b* is a flowchart illustrating a method of operating the sensor module SM of the sensing unit 110 shown in FIG. 3.

Referring to FIGS. 2, 3, and 4*b*, FIG. 4*b* may be a process of transmitting the second alarm transmission signal SG1-2*a*. The second alarm transmission signal SG1-2*a* may be a signal obtained by amplifying a signal received from another adjacent sensing unit among the plurality of sensing units by the sensing unit 110. In the process of transmitting the alarm information, the signal including the alarm information may have a reduced transmission rate and accuracy due to a transmission distance and noise. Accordingly, the signal of which the quality has been degraded may be amplified through the amplification unit AMP and transmitted through the communication unit ATN. In this case, the accuracy, transmission rate, and transmission distance of the signal including the alarm information transmitted to the relay system 200 (refer to FIG. 1) may be increased.

The sensor module SM may stand by in a power saving mode. The sensor module SM may change to the normal mode when receiving an activation signal from another adjacent sensor module SM.

Upon receiving the activation signal, the sensor module SM may operate in a power saving mode when the activation signal is less than a certain level, and may operate in a normal mode when the activation signal is greater than or equal to a certain level.

The sensor module SM may compare the activation signal with a reference value when the activation signal is greater than or equal to a certain level. If the activation signal does not match the reference value, the sensor module SM may determine the activation signal as another signal and operate in the power saving mode. The sensor module SM may operate in the normal mode if the activation signal is equal to the reference value.

The sensor module SM may receive the first alarm transmission signal SG1-1*a* or the second alarm transmission signal SG1-2*a* from another adjacent sensor module.

When the same signal as the previously received first and second transmission signals SG1-1*a* and SG1-2*a* is received, the sensor module SM may ignore the first and second transmission signals SG1-1*a* and SG1-2*a* and operate in a power saving mode.

The amplification unit AMP may amplify the received first and second transmission signals SG1-1*a* and SG1-2*a* into the second alarm transmission signal SG1-2*a*.

The communication unit ATN may transmit the second alarm transmission signal SG1-2*a* to the relay system 200. The relay system 200 that has received the second alarm transmission signal SG1-2*a* may transmit the second alarm reception signal SG1-2*b* to the communication unit ATN. The communication unit ATN may receive the second alarm reception signal SG1-2*b* from the relay system 200. The communication unit ATN may confirm that the relay system 200 has received the second alarm transmission signal SG1-2*a* by receiving the second alarm reception signal SG1-2*b* from the relay system 200.

The communication unit ATN may sequentially transmit the activation signal and the second alarm transmission signal SG1-2*a* to at least one sensing unit among a plurality of adjacent sensing units. The at least one sensing unit that has received the second alarm transmission signal SG1-2*a* may transmit the second alarm reception signal SG1-2*b* to the communication unit ATN. The communication unit ATN may receive the second alarm reception signal SG1-2*b* from the relay system 200. The communication unit ATN may confirm that the at least one sensing unit has received the second alarm transmission signal SG1-2*a* by receiving the second alarm reception signal SG1-2*b*.

The sensor module SM may stand by again in a power saving mode.

According to the inventive concept, the sensor module SM may operate by being divided into a power saving mode that does not consume power and a normal mode that operates in a fire situation, thereby minimizing power of the sensing unit 110. Therefore, the fire alarm system FAS (refer to FIG. 1) may be driven with low power.

Figure 5:
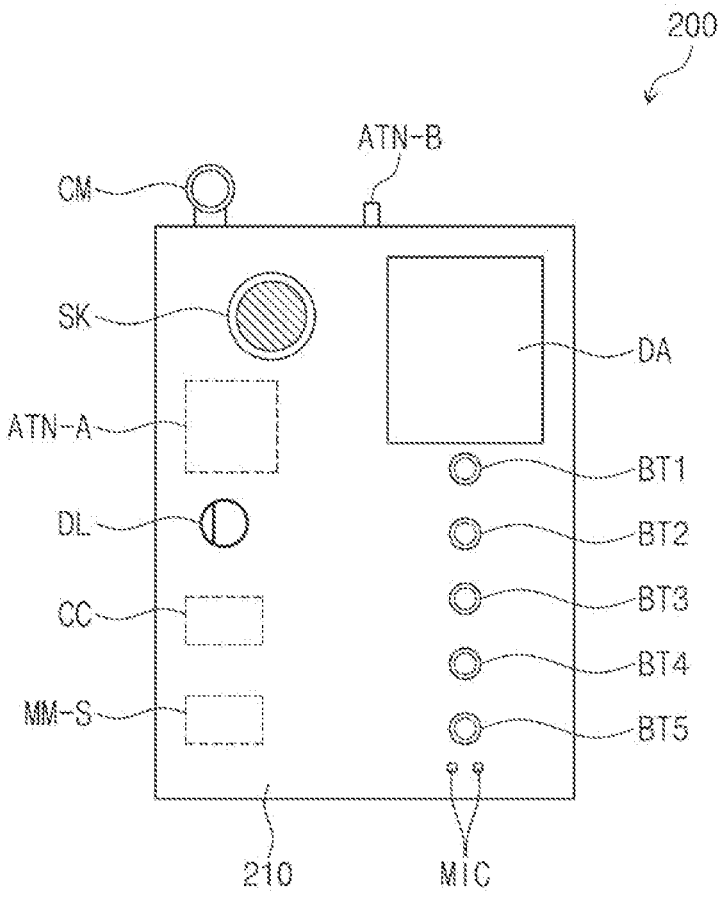
FIG. 5 shows the relay system shown in FIG. 1.
Figure 6:
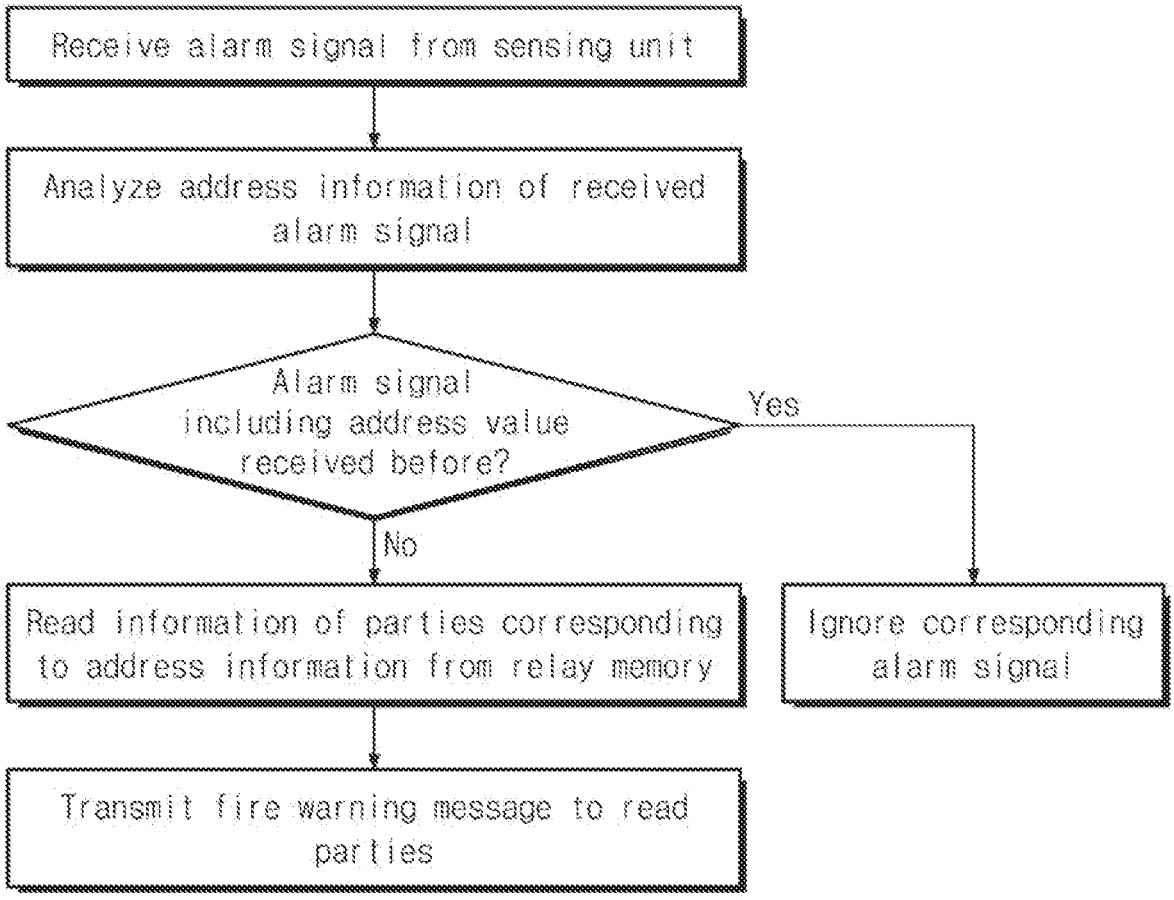
FIG. 6 is a flowchart illustrating a method in which the repeater shown in FIG. 5 operates.

FIG. 5 shows the relay system 200 shown in FIG. 1. FIG. 6 is a flowchart illustrating a method in which the repeater 210 shown in FIG. 5 operates.

Referring to FIGS. 5 and 6, the relay system 200 may include a repeater 210.

The repeater 210 may receive big data from the external server BS (refer to FIG. 1). The repeater 210 may use the big data as data for determining whether a fire has occurred. For example, the repeater 210 may determine whether the values detected by the sensors SS1, SS2, and SS3 of the sensing unit 110 using the big data are considered invalid data such as water vapor, cigarette smoke, and exhaust gas.

For example, if the current surrounding environment is an environment (e.g., winter, late-night time, industry that uses a lot of fire, etc.) with a high probability of fire depending on the received big data, the repeater 210 may more sensitively determine whether a fire has occurred. According to the received big data, if the current surrounding environment (e.g., high humidity, daytime hours, crowded locations, etc.) is an environment with a low probability of fire, the repeater 210 may determine whether a fire has occurred less sensitively.

In one embodiment of the inventive concept, the control unit CC of the repeater 210 may calculate the probability of a fire by using big data received through an external server (BS, refer to FIG. 1), and in a case where the probability of occurrence of a fire is greater than or equal to a predetermined value (e.g., 80%), even if the sensing unit 110 does not detect the occurrence of a fire, may generate a warning sound through the speaker SK.

In one embodiment of the inventive concept, the fire alarm system FAS (refer to FIG. 1) may be utilized as a pre-recognition type fire alarm system that uses big data to determine the probability of a fire, and warns before a fire occurs if it is determined that the probability of a fire is high.

The repeater 210 includes a reception unit ATN-A, a control unit CC (or a control circuit), a memory MM-S, a transmission unit ATN-B, a display unit DA, a speaker SK, a microphone MIC, a camera CM, first to fifth buttons BT1, BT2, BT3, BT4, and BT5, and a door lock DL.

The reception unit ATN-A may receive the first transmission signal SG1-1 transmitted by each of the plurality of sensing units.

The control unit CC may control the plurality of sensing units, and recognize alarm information included in the first and second alarm signals SG1-01 and SG1-02.

When the address information included in the identified alarm information is the same as the previously recognized address information, the control unit CC may control the repeater 210 to ignore the corresponding alarm information. When the identified address information is different from the previously recognized address information, the control unit CC may transmit a warning message to the parties corresponding to the identified address information in the memory MM-S. Through such control, it is possible to prevent the warning message from repeatedly transmitting the same message to the parties 20 (refer to FIG. 2).

Information (e.g., contact information, address, or name) of the parties 20 (refer to FIG. 2) may be stored in the memory MM-S. Information of the parties 20 (refer to FIG. 2) stored in the memory MM-S may be matched with address information of each of the plurality of sensing units.

The memory MM-S may include a volatile memory or a non-volatile memory. Volatile memory may include DRAM, SRAM, flash memory, or FeRAM. Non-volatile memory may include SSD or HDD.

The transmission unit ATN-B may transmit a fire alarm message to the parties 20 (refer to FIG. 2). The repeater 210 may transmit a fire alarm message to the parties 20 (refer to FIG. 2) corresponding to the identified address information among the information of the parties 20 (refer to FIG. 2) stored in the memory MM-S. At this time, the parties 20 (refer to FIG. 2) corresponding to the identified address information may include the owner of the place where the fire occurred, the family of the owner of the place where the fire occurred, the owner of the place adjacent to the place where the fire occurred, the fire department having jurisdiction, or a public institution concerned.

The transmission unit ATN-B may transmit the first reception signal SG1-2 to the plurality of sensing systems 110 (refer to FIG. 1) and adjacent relay systems 200*a* and 200*b* (refer to FIG. 1). The sensing system 110 (refer to FIG. 1) and adjacent relay systems 200*a* and 200*b* (refer to FIG. 1) that have received the first reception signal SG1-2 determine that the transmitted alarm information has been properly transmitted to the repeater 210.

The transmission unit ATN-B may transmit information in a Wideband Code Division Multiple Access (WCDMA) communication method. WCDMA is stronger in frequency selective fading as the bandwidth increases, and the bandwidth increases when the same data is transmitted, and since the processing gain is increased, the corresponding amount of interference may be reduced and the capacity may be increased. In addition, since multipath may be resolved, propagation delay in an indoor environment may be overcome even in the case of microcells. Therefore, WCDMA may be effective in transmitting a fire alarm message in a fire situation in which a stable message must be transmitted quickly due to an urgent situation. And it has excellent bandwidth efficiency per 1 MHz bandwidth, which is advantageous in terms of subscriber capacity, and by reducing the capacity of the power amplifier by increasing the processing gain, the implementation cost may be reduced, and by reducing the size of the power amplifier, the power consumption and size of the terminal may be reduced.

The display unit DA may provide image information corresponding to the state of the sensing system 100 (refer to FIG. 2) or the state of the relay system 200. The display unit DA may include a liquid crystal display panel or an organic light emitting display panel.

The speaker SK may emit an alarm sound when the repeater 210 receives the first transmission signal SG1-1 (refer to FIG. 1).

The microphone MIC may recognize a user's voice in the vicinity of the repeater 210. The microphone MIC may be used to recognize a user's voice command in an emergency situation. In this case, the repeater 210 may have a built-in program or system for recognizing the user's voice command.

The camera CM may detect and/or recognize a movement of a user in the vicinity of the repeater 210.

The user may manually report a fire by pressing the first button BT1 or by applying a touch to the fire department. In the initial fire stage, etc., before the sensing system 100 (refer to FIG. 2) detects a fire, when people around the repeater 210 discover a fire, it is possible to quickly report the occurrence of a fire.

The user may stop generating the alarm sound from the speaker SK by pressing the second button BT2 or applying a touch.

The user may communicate (or call) with an external communication device by pressing the third button BT3 or applying a touch. After the user presses the third button BT3, the user may transmit voice information to the other party through the microphone MIC and receive voice information from the other party through the speaker SK.

The user may check the state of the sensing system 100 (refer to FIG. 2) or the relay system 200 by pressing the fourth button BT4 or applying a touch. For example, although there is no fire, the relay system 200 may receive the virtual first transmission signal SG1-1 from the sensing system 100 (refer to FIG. 2) and the relay system 200 may transmit a warning message to at least one of the parties 20 (refer to FIG. 2). In this way, it may be checked whether the fire alarm system FAS (refer to FIG. 1) according to an embodiment of the inventive concept operates normally.

Also, the relay system 200 may transmit an operation check signal to each of the plurality of sensing units. Each of the plurality of sensing units operating in the power saving mode may receive an operation check signal and operate in the normal mode. In this case, each of the plurality of sensing units may operate in a power saving mode after transmitting the communication operation state to the repeater 210.

According to the inventive concept, the fire alarm system FAS (refer to FIG. 1) operates by being divided into a power saving mode in which the sensing system 100 (refer to FIG. 2) does not consume power and a normal mode operating in a fire situation, thereby minimizing power use of the sensing unit 110 (refer to FIG. 2). Therefore, the fire alarm system FAS (refer to FIG. 1) may be driven with low power.

The user may initialize the signal transmission path stored in the sensor memory MM (refer to FIG. 3) of the sensing unit 110 (refer to FIG. 1) by pressing the fifth button BT5 or applying a touch.

The user may open the outer case of the repeater 210 by using the door lock DL. After opening the outer case, the built-in parts may be easily inspected.

Although not shown in the drawing, the repeater 210 may include a separate battery therein. In addition, if the power supply to a party is interrupted, the repeater 210 may include a function of recording this and notifying the party of the corresponding content.

Figure 7:
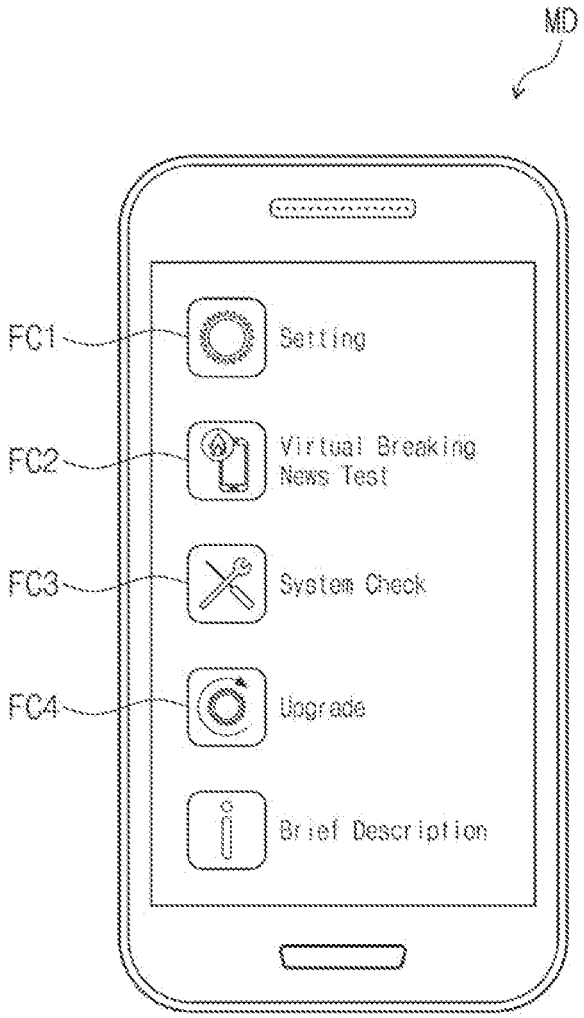
FIG. 7 illustrates a terminal of the party shown in FIG. 1.

FIG. 7 illustrates a terminal MD of the party shown in FIG. 1.

The terminal MD may include a smart phone, a desktop computer, a laptop computer, a tablet PC, or a wearable device. However, this is exemplary and the terminal MD of the inventive concept may include various devices capable of communication. FIG. 7 illustrates a smartphone as an example of a terminal MD of a party.

The party may remotely control the sensing system 100 (refer to FIG. 2) or the relay system 200 (refer to FIG. 2) by using the terminal MD. At this time, the terminal MD may transmit a control signal to the sensing system 100 (refer to FIG. 2) or the relay system 200 (refer to FIG. 2).

The functions FC1, FC2, FC3, and FC4 that may be controlled using the terminal MD may include the first function FC1, the second function FC2, the third function FC3, and the fourth function FC4.

The first function FC1 may be a setting function. The party 20 (refer to FIG. 2) may input the serial number of each of the plurality of sensing units using the first function FC1, or input information (contact information) of parties 20 (refer to FIG. 2) to receive the fire alarm message, or input the address of a place where each of the plurality of sensing units is installed.

The second function FC2 may be a virtual breaking news test function. The party 20 (refer to FIG. 2) may check whether the repeater 210 (refer to FIG. 2) normally transmits the fire alarm message from a remote location using the second function FC2.

The third function FC3 may be a system check function. The party 20 (refer to FIG. 2) may check the operation state (e.g., whether power is being applied normally, etc.) of the sensing system 100 (refer to FIG. 2) or the relay system 200 (refer to FIG. 2) by using the third function FC3.

The fourth function FC4 may be an upgrade function. The party 20 (refer to FIG. 2) may remotely check the firmware version of the repeater 210 (refer to FIG. 2) using the terminal MD and upgrade the firmware.

Figure 8:
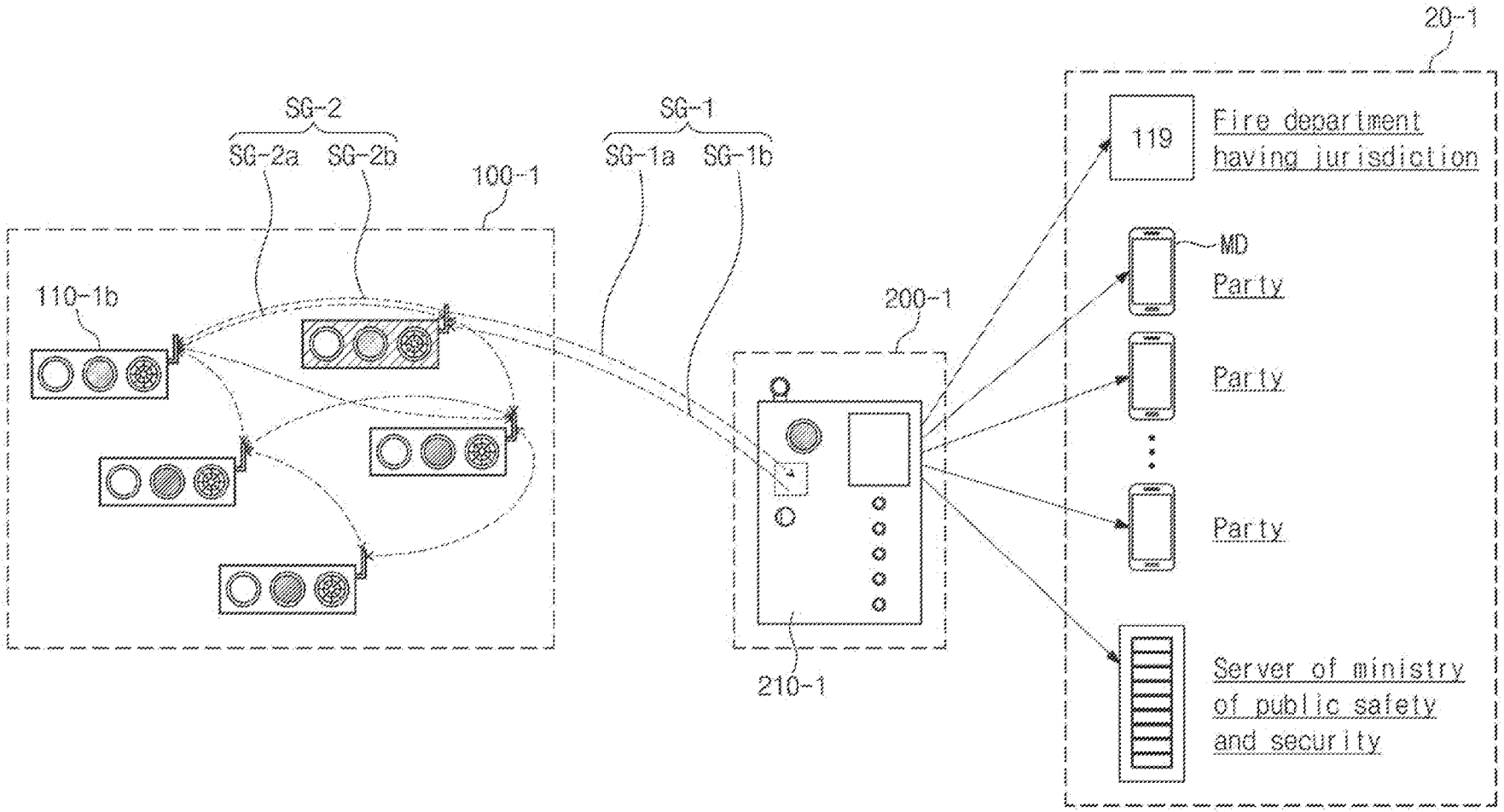
FIG. 8 illustrates a sensing system and a relay system according to an embodiment of the inventive concept.

FIG. 8 illustrates a sensing system 100-1 and a relay system 200-1 according to an embodiment of the inventive concept. Components described with reference to FIGS. 1 and 2 are denoted by the same reference numerals, and descriptions thereof will be omitted.

Referring to FIGS. 1, 2 and 8, the sensing system 100-1 may include a plurality of sensing units. In FIG. 8, five sensing units are illustrated by way of example, but the inventive concept is not limited thereto.

Each of the plurality of sensing units may have different address information. Each of the plurality of sensing units may transmit alarm information including the address information to the relay system 200-1 when detecting a fire.

The plurality of sensing units may include at least one first sensing unit 110-1*a* and at least one second sensing unit 110-1*b*. For example, the number of the second sensing units 110-1*b* may be greater than the number of the first sensing units 110-1*a*. In FIG. 8, one first sensing unit 110-1*a* and four second sensing units 110-1*b* are illustrated by way of example, but the inventive concept is not limited thereto.

The first sensing unit 110-1*a* may transmit the first sensing signal SG-1 including the alarm information only to the relay system 200-1. The first sensing signal SG-1 may not be transmitted to the plurality of sensing units.

Since the first sensing signal SG-1 transmitted from the first sensing unit 110-1*a* does not receive signal interference, accuracy and transmission rate of information transmitted to the relay system 200-1 may be increased.

The second sensing unit 110-1*b* may transmit the second sensing signal SG-2 including the alarm information only to at least one adjacent sensing unit among the plurality of sensing units. The second sensing signal SG-2 may not be transmitted to the relay system 200-1.

The second sensing signal SG-2 transmitted from the second sensing unit 110-1*b* is transmitted only to the adjacent at least one sensing unit so that signal interference and power consumption may be reduced by reducing the amount of transmitted signals. According to the inventive concept, when implementing a fire alarm system FAS (refer to FIG. 1), each of the plurality of sensing systems may include at least one first sensing unit 110-1*a* and at least one second sensing unit 110-1*b*. Alarm information may be stably transmitted due to the operations of the first sensing unit 110-1*a* and the second sensing unit 110-1*b*. Therefore, it is possible to provide a fire alarm system with improved reliability.

Although described above with reference to a preferred embodiment of the inventive concept, a person skilled in the relevant technical field or a person having ordinary knowledge in the relevant technical field will be appreciated that various modifications and changes may be made to the inventive concept without departing from the spirit and scope of the inventive concept described in the claims to be described later. Accordingly, the technical scope of the inventive concept should not be limited to the contents described in the detailed description of the specification, but should be defined by the claims.

INDUSTRIAL APPLICABILITY

In the fire alarm system, even when a malfunction occurs in the relay system, notifying the party of the occurrence of a fire may improve the reliability of the fire alarm system. Therefore, the inventive concept related to a fire alarm system has high industrial applicability.

The invention claimed is:

1. A fire alarm system comprising:

a plurality of sensing systems, each sensing whether a fire has occurred; and a plurality of relay systems each corresponding to any one of the plurality of sensing systems, performing Radio Frequency (RF) communication with the plurality of sensing systems, and performing RF communication with each other, wherein each of the plurality of sensing systems comprises a plurality of sensing units having different address information, wherein when detecting a fire, each of the plurality of sensing units transmits alarm information to a corresponding relay system among the plurality of relay systems, wherein when receiving alarm information from another adjacent sensing unit, each of the plurality of sensing units transmits the alarm information to a corresponding relay system among the plurality of relay systems, wherein each of the plurality of relay systems comprises:

a memory in which information of parties corresponding to the address information is stored; and a reception unit configured to receive the alarm information from the plurality of sensing units, wherein when receiving the alarm information, the reception unit transmits a warning message to devices corresponding to the parties, and transmits the alarm information to adjacent relay systems among the plurality of relay systems.

2. The fire alarm system of claim 1, wherein when the alarm information is not received from a corresponding relay system among the plurality of relay systems, each of the plurality of sensing units transmits the alarm information to another adjacent relay system among the plurality of relay systems.

3. The fire alarm system of claim 1, wherein each of the plurality of relay systems receives big data from an external server, and uses the big data to determine whether values sensed by the plurality of sensing units are invalid data such as water vapor, cigarette smoke, and exhaust gas.

4. The fire alarm system of claim 3, wherein each of the plurality of relay systems analyzes data on the address information using the big data, identifies sub-parties that should receive the warning message in addition to information on parties corresponding to the address information, and transmits the warning message to the sub-parties.

5. The fire alarm system of claim 1, wherein when alarm information is received from any one of the plurality of relay systems, each of the plurality of sensing units stores a signal transmission path of the alarm information.

6. The fire alarm system of claim 1, further comprising an activation signal for changing from a power saving mode that does not consume power to a normal mode operated when the fire is detected and a first alarm transmission signal including the alarm information, wherein if the fire is detected, after changing from the power saving mode to the normal mode, each of the plurality of sensing units transmits the first alarm transmission signal to a corresponding relay system among the plurality of relay systems, transmits the activation signal to an adjacent sensing unit among the plurality of sensing units, and transmits a first alarm transmission signal after a predetermined time elapses.

7. The fire alarm system of claim 6, further comprising a second alarm transmission signal amplifying the first alarm transmission signal, wherein when receiving the activation signal, after changing from the power saving mode to the normal mode, each of the plurality of sensing units transmits the second alarm transmission signal to a corresponding relay system among the plurality of relay systems, transmits the activation signal to an adjacent sensing unit among the plurality of sensing units, and transmits the second alarm transmission signal after a predetermined time elapses.

8. The fire alarm system of claim 6, wherein each of the plurality of sensing units operates in the power saving mode, and operates in the normal mode when a magnitude of the received activation signal is greater than or equal to a predetermined value.

9. The fire alarm system of claim 1, wherein each of the plurality of sensing units ignores the received alarm information when the same alarm information as the previously received alarm information is received.

10. The fire alarm system of claim 1, wherein when the same alarm information as previously received alarm information is received, each of the plurality of relay systems ignores the received alarm information.

* * * * *